US005272995A

United States Patent [19]

Harger

[11] Patent Number: 5,272,995

[45] Date of Patent: Dec. 28, 1993

[54] QUILTING METHOD AND PRODUCTS THEREOF

[76] Inventor: Rebecca A. Harger, 16222 Prairie Baptist Rd., Noblesville, Ind. 46060

[21] Appl. No.: 744,999

[22] Filed: Aug. 14, 1991

[51] Int. Cl.[5] ..... D05B 97/00

[52] U.S. Cl. ..... 112/262.1; 112/440; 112/1

[58] Field of Search ..... 112/440, 117, 262.1, 112/262.3, 1; 5/400, 482, 502

[56] References Cited

U.S. PATENT DOCUMENTS

| | | | |
|---|---|---|---|
| 266,751 | 10/1882 | Bigelow | 112/262.1 |
| 2,515,450 | 7/1950 | Hull | 112/400 |
| 3,270,696 | 9/1966 | Lowenstein | 112/262.1 |
| 3,898,943 | 8/1975 | Brandon et al. | 112/262.1 |
| 4,320,634 | 3/1982 | Hashimoto | 66/202 |
| 4,426,945 | 1/1984 | A-Yan | 112/440 X |
| 4,506,616 | 3/1985 | Nixon | 112/262.1 |
| 4,665,849 | 5/1987 | Kelly | 112/262.3 |

*Primary Examiner*—Peter Nerbun
*Assistant Examiner*—Larry D. Worrell, Jr.
*Attorney, Agent, or Firm*—Woodard, Emhardt, Naughton, Moriarty & McNett

[57] ABSTRACT

A method of constructing a patchwork quilt by (1) providing a number of pieces of foldable material specifically shaped to be folded and sewn together to make a quilt that appears to be made with a larger number of pieces than are actually used; (2) folding the material to give the appearance that each piece is made of several smaller pieces which have been sewn together; (3) sewing the pieces of folded material together to form a block suitable for use as one block of the top layer of a quilt; (4) providing layers of insulating material and backing adjacent to the bottom surface of the composite piece; (5) sewing the three layers together so that the fabric is quilted and pieced all in one step to form a patchwork quilt block; and (5) joining several blocks together to make a quilt.

22 Claims, 7 Drawing Sheets

QUILTING METHOD AND PRODUCTS THEREOF

FIELD OF THE INVENTION

This invention relates generally to methods of making quilts, and more particularly to an improved method of quilt block piecing and assembly.

BACKGROUND OF THE INVENTION

Quilts are multi-layered coverlets having top and bottom layers of fabric with a layer of insulating material in between. Traditional patchwork quilts are constructed so that the top layer of fabric contains a multiplicity of pieces sewn together in an ornamental design. The construction of these patchwork quilts is known to be extremely time consuming as the various sections are cut, pieced and sewn together. The completed quilt, however, can be a stunning testament to its maker's skill, so that a well-crafted quilt is valued as much for its artistic appeal as for its utilitarian features.

One disadvantage known in the art of patchwork quiltmaking is the enormous investment of time which is required to fashion each quilt. Traditional quiltmaking methods generally favor the construction of a number of "blocks" comprised of a plurality of smaller pieces. The blocks are typically square, but other shapes are known. Once the individual blocks have been made they are joined together to form the top layer of the finished quilt. The number of blocks in a finished quilt typically varies from about 10 to more than 100, with each block being comprised of many smaller pieces. Because the small pieces are traditionally sewn together piece-by-piece ("pieced" together) to form the individual blocks, a great number of stitches are required and even a simple design may take many weeks to construct.

In an effort to reduce the amount of time required to make a patchwork quilt, several improvements in the traditional methodology have been developed. For example, the use of an automatic sewing machine to piece the cloth into blocks and the blocks into a quilt was an early "improvement" in the art. Additionally, methods whereby long strips of fabric are sewn together to form a new fabric, which is then cut apart to form sections of a quilt block are known. None of the known methods, however, provides a significant time savings by actually reducing the number of stitches required for any particular pattern or the number of pieces required to be pieced.

A need therefore exists for a method of making a patchwork quilt which appears to be comprised of a large number of individually sewn together pieces, but which does not require the traditional investment of time. The present invention addresses this need.

SUMMARY OF THE INVENTION

One preferred embodiment of the present invention relates to a method of constructing a patchwork quilt by (1) providing a number of pieces of foldable material specifically shaped to be folded and sewn together to make a quilt that appears to be comprised of a larger number of pieces than are actually used; (2) folding the material to give the appearance that each piece is comprised of several smaller pieces which have been sewn together; (3) interleaving and sewing the pieces of folded material together to form a block suitable for use as one block of the top layer of a quilt; (4) providing layers of insulating material and backing adjacent to the bottom surface of said top layer so that the three layers form one patchwork quilt block; and (5) joining several blocks together to make a quilt.

One object of the present invention is to provide a quick and easy method of making a quilt which appears to have been laboriously pieced together.

Another object of the present invention is to provide a finished quilt which gives the appearance that it was laboriously pieced together, but is significantly easier to construct.

Further objects and advantages of the present invention will be apparent from the following description and claims.

FIG. **9*a*** is a top plan view of one piece of foldable material which has been cut according to a typical embodiment of the present invention, showing the location of the lines along which the material is to be folded. This piece is cut according to the Log Cabin Hexagon pattern.

FIG. **9*b*** is a top plan view of a second piece of foldable material which has been cut according to a typical embodiment of the present invention, showing the location of the lines along which the material is to be folded. This piece is cut according to the Log Cabin Hexagon pattern.

Figure 10:
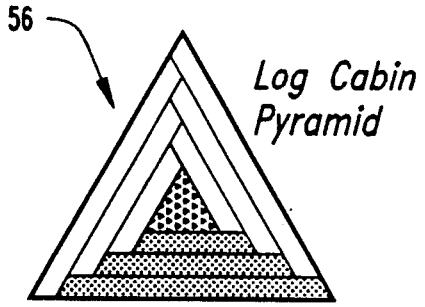

FIG. 10 is a top plan view of one block of the top layer of a quilt according to a typical embodiment of the present invention. The pattern shown is Log Cabin Pyramid.

FIG. **11*a*** is a top plan view of a piece of foldable material which has been cut according to a typical embodiment of the present invention, showing the location of the lines along which the material is to be folded.

This piece is cut according to the Log Cabin Pyramid pattern.

Figure 11A:
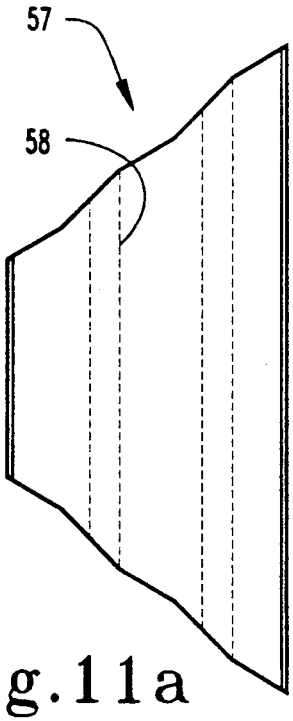
Figure 11B:
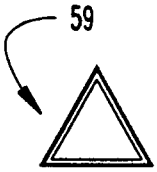

FIG. 11*b* is a top plan view of a piece of non-folded material which forms the center of a quilt block according to one Log Cabin Pyramid embodiment of the present invention.

Figure 12:
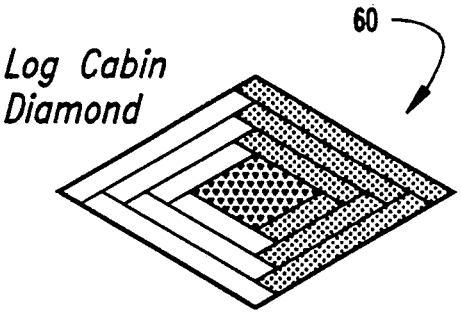

FIG. 12 is a top plan view of one block of the top layer of a quilt according to a typical embodiment of the present invention. The pattern shown is Log Cabin Diamond.

Figure 13A:
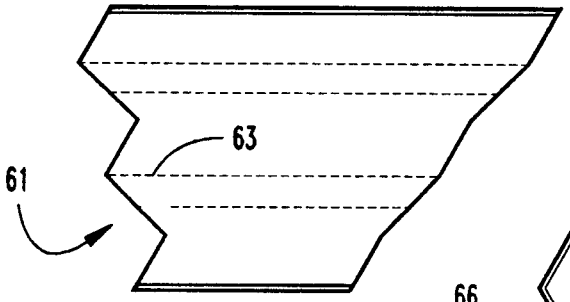

FIG. 13*a* is a top plan view of one piece of foldable material which has been cut according to a typical embodiment of the present invention, showing the location of the lines along which the material is to be folded. This piece is cut according to the Log Cabin Diamond pattern.

Figure 13C:
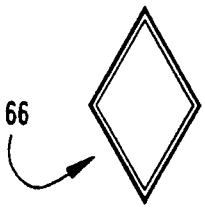
Figure 13B:
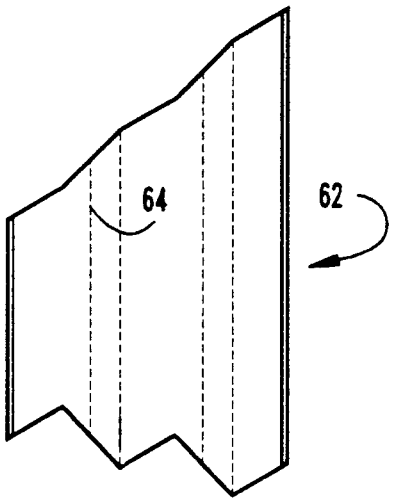

FIG. 13*b* is a top plan view of a second piece of foldable material which has been cut according to a typical embodiment of the present invention, showing the location of the lines along which the material is to be folded. This piece is cut according to the Log Cabin Diamond pattern.

FIG. 13*c* is a top plan view of a piece of non-folded material which forms the center of a quilt block according to one Log Cabin Diamond embodiment of the present invention.

Figure 14:
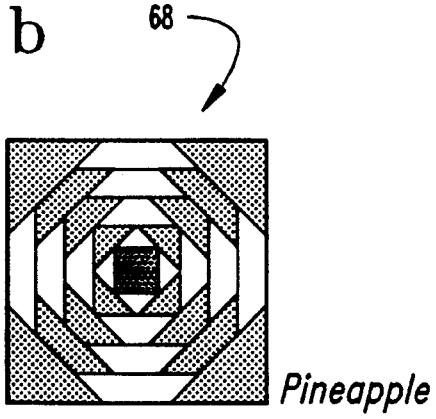

FIG. 14 is a top plan view of one block of the top layer of a quilt according to a typical embodiment of the present invention. The pattern shown is Pineapple.

Figure 15A:
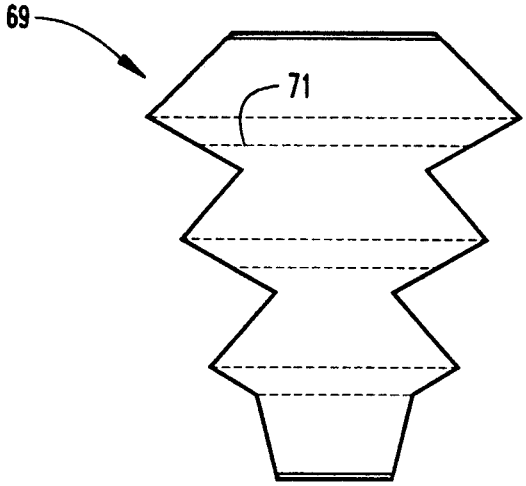

FIG. 15*a* is a top plan view of one piece of foldable material which has been cut according to a typical embodiment of the present invention, showing the location of the lines along which the material is to be folded. This piece is cut according to the Pineapple pattern.

Figure 15B:
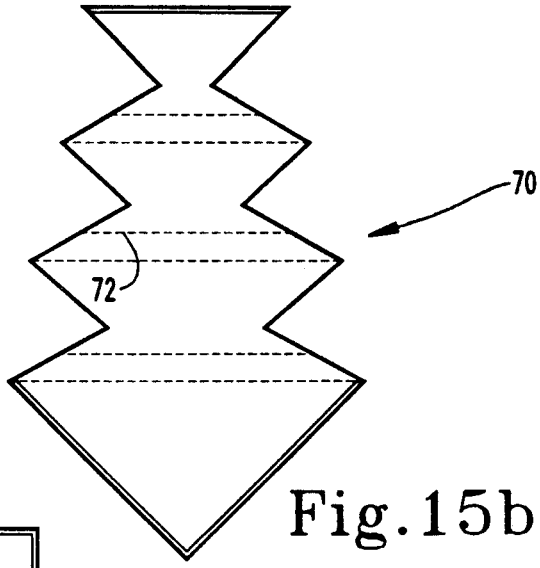

FIG. 15*b* is a top plan view of a second piece of foldable material which has been cut according to a typical embodiment of the present invention, showing the location of the lines along which the material is to be folded. This piece is cut according to the Pineapple pattern.

Figure 15C:
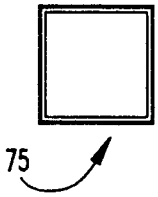

FIG. 15*c* is a top plan view of a piece of non-folded material which forms the center of a quilt block according to the Pineapple pattern embodiment of the present invention.

Figure 16:
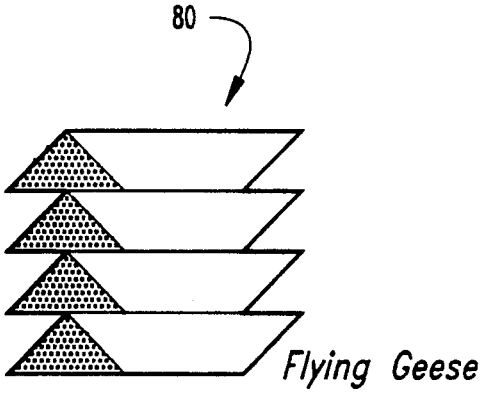

FIG. 16 is a top plan view of one block of the top layer of a quilt according to a typical embodiment of the present invention. The pattern shown is Flying Geese.

Figure 17B:
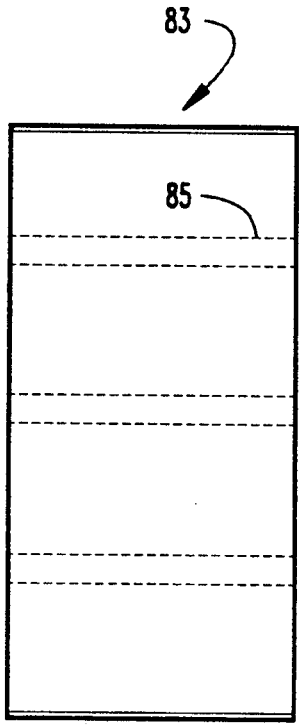
Figure 17A:
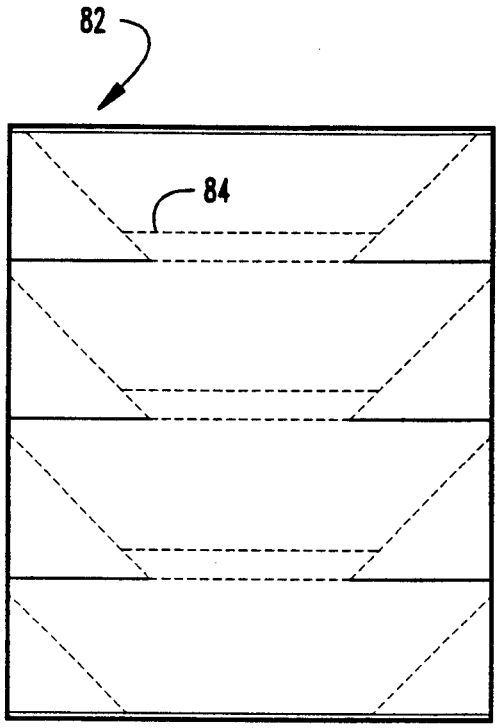

FIG. 17*a* is a top plan view of one piece of foldable material which has been cut according to a typical embodiment of the present invention, showing the location of the lines along which the material is to be folded. This piece is cut according to the Flying Geese pattern.

FIG. 17*b* is a top plan view of a second piece of foldable material which has been cut according to a typical embodiment of the present invention, showing the location of the lines along which the material is to be folded. This piece is cut according to the Flying Geese pattern.

Figure 18:
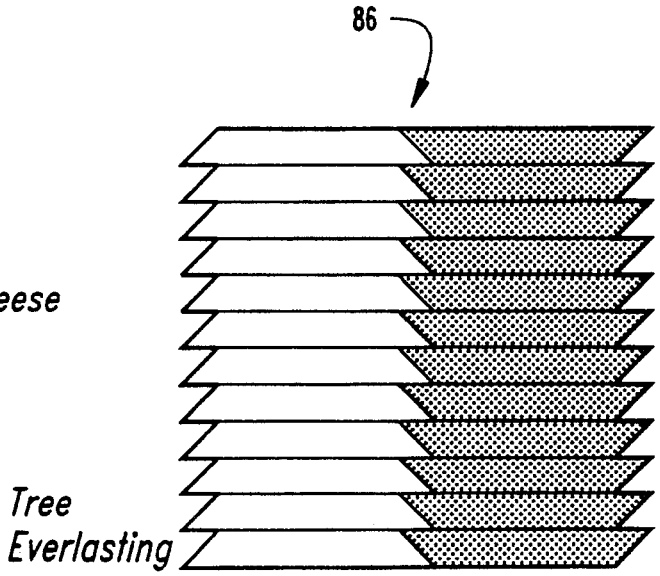

FIG. 18 is a top plan view of one block of the top layer of a quilt according to a typical embodiment of the present invention. The pattern shown is Tree Everlasting.

Figure 19B:
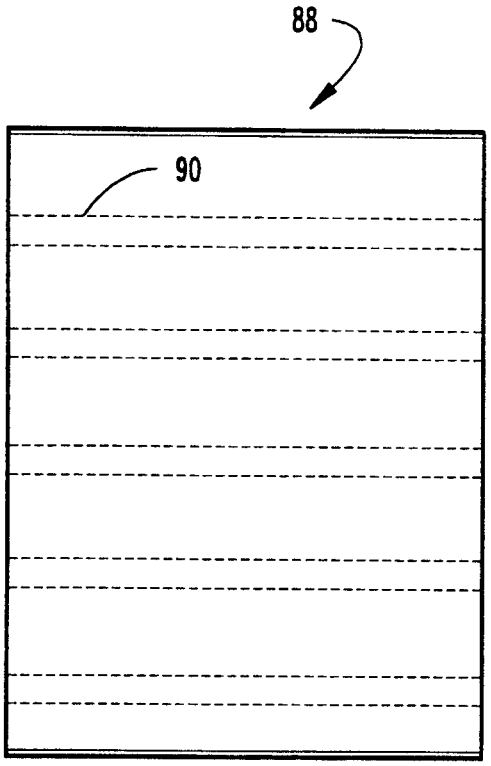
Figure 19A:
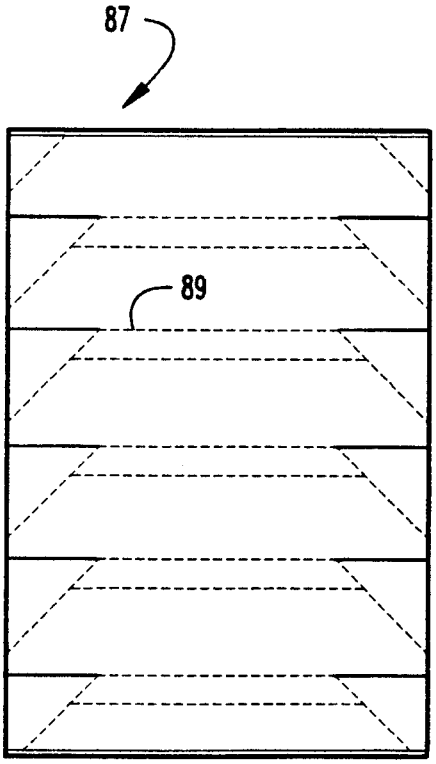

FIG. 19*a* is a top plan view of one piece of foldable material which has been cut according to a typical embodiment of the present invention, showing the location of the lines along which the material is to be folded. This piece is cut according to the Tree Everlasting pattern.

FIG. 19*b* is a top plan view of a second piece of foldable material which has been cut according to a typical embodiment of the present invention, showing the location of the lines along which the material is to be folded. This piece is cut according to the Tree Everlasting pattern.

DESCRIPTION OF THE PREFERRED EMBODIMENTS

For the purposes of promoting an understanding of the principles of the invention, reference will now be made to certain embodiments and specific language will be used to describe the same. It will nevertheless be understood that no limitation of the scope of the invention is thereby intended, such alterations, further modifications and applications of the principles of the invention as described herein being contemplated as would normally occur to one skilled in the art to which the invention relates.

Figure 1:
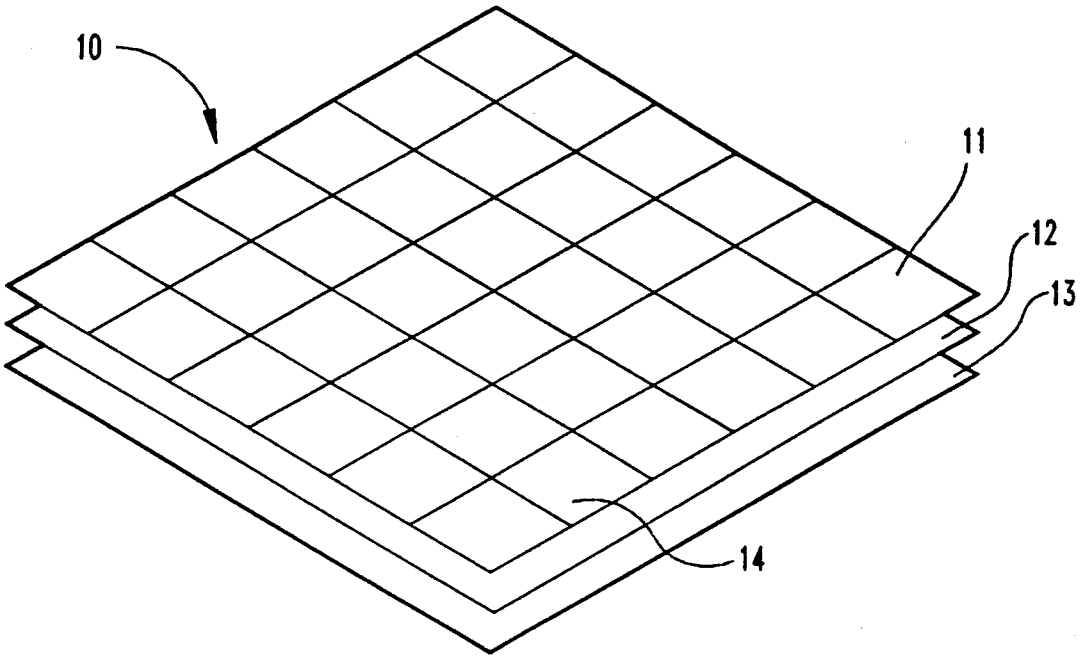
FIG. 1 is an exploded perspective view of a quilt according to a typical embodiment of the present invention.

As indicated above, one preferred embodiment of this invention relates to a method of making a patchwork quilt so that the finished quilt gives the appearance that it was made from a greater number of pieces than were actually used. Accordingly, FIG. 1 shows the basic components of a quilt. In particular, quilt 10 is comprised of a top layer 11, a middle batting layer 12, and a (bottom) backing layer 13. Top layer 11 is further comprised of a number of quilt blocks 14 which are joined together to form the top layer of the quilt. The three layers are typically sewn together, or quilted, along the edges of the quilt blocks, and may be further quilted within the blocks.

Figure 2:
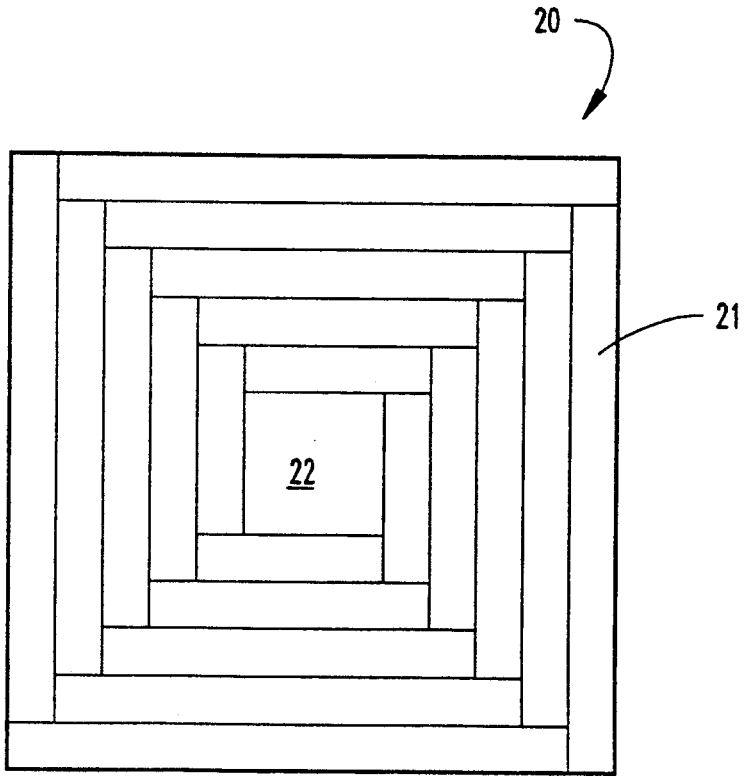
FIG. 2 is a top plan view of one block of the top layer of a quilt according to a typical embodiment of the present invention. The pattern shown is Log Cabin Square.

A quilt block having the traditional "Log Cabin" pattern is shown in FIG. 2 and is referred to more specifically as Log Cabin Square The block appears to be comprised of a number of rectangular pieces 21 arranged around a center square 22.

Figure 3:
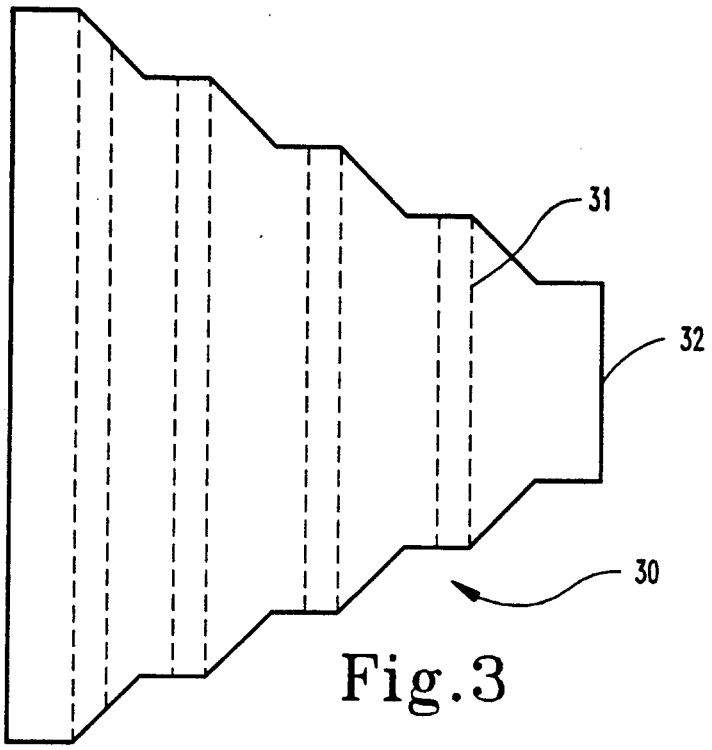
FIG. 3 is a top plan view of one piece of foldable material which has been cut according to a typical embodiment of the present invention, showing the location of the lines along which the material is to be folded. This piece is cut according to the Log Cabin Square pattern.

The preferred methodology of the present invention begins by cutting or otherwise fashioning pieces of material into shapes which are appropriate for folding into folded pieces which appear to be comprised of a greater number of smaller pieces and which fit together in a predetermined pattern to form one block of the top of a quilt. FIG. 3 shows a piece of material 30 cut according to the present invention to make the Log Cabin Square pattern. Fold lines 31, and narrow end 32 are also shown.

Figure 4:
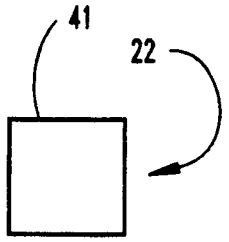
FIG. 4 is a top plan view of the piece of material which is not folded in the making of the Log Cabin Square pattern.

With many patterns it is also advantageous to provide a number of pieces which will not be folded before piecing the quilt together These pieces are typically squares, circles or triangles, but other shapes may remain unfolded. A piece of non-foldable material 22 cut to make the Log Cabin Square pattern according to the present invention is shown in FIG. 4.

Figure 6:
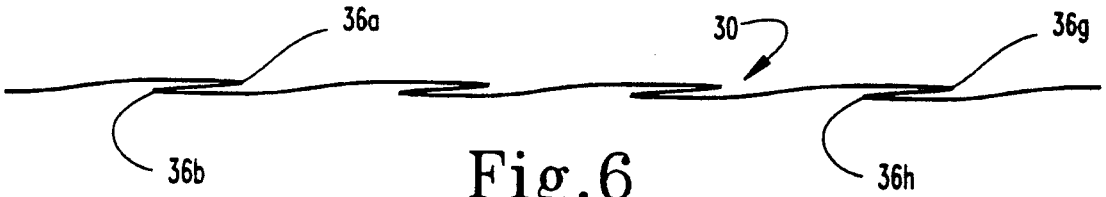
FIG. 6 is a side elevational view of a piece of substantially folded material as is shown in FIG. 5, taken along line 6—6 of FIG. 5 in the direction of the arrows.
Figure 5:
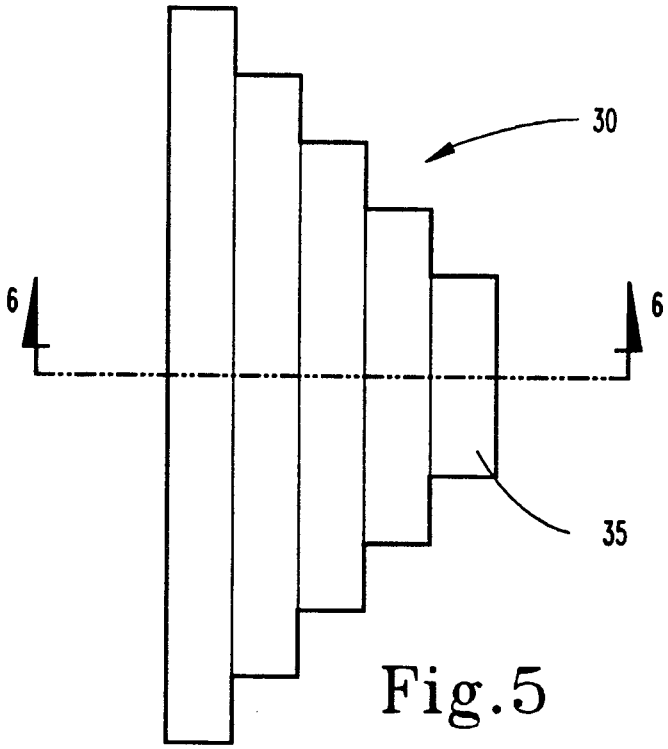
FIG. 5 is a top plan view of a folded piece of material cut and folded according to a typical embodiment of the present invention, showing the Log Cabin Square pattern.

Once the pieces have been cut to their appropriate shapes they are folded to give the appearance that each piece is a composite of several smaller pieces. The precise folds used for each piece depend on the pattern or effect desired by the quiltmaker. In some preferred embodiments for example, a series of parallel folds are used to make a series of adjacent blocks which appear to be individually cut and pieced in the traditional way. To make the popular Log Cabin Square design shown in FIG. 2, for example, the folds are made "accordion style," i.e., the material is folded back and forth over itself a number of times to provide a multiplicity of overlapping layers as shown in FIG. 6. The lines along which the material is folded to make Log Cabin Square according to the present invention are shown as dash lines 31 of FIG. 3, while the folded piece is shown from two perspectives in FIG. 5 and FIG. 6. In particular, FIG. 5 shows folded piece of material 30, which appears to be made from a series of smaller rectangles 35. FIG. 6 shows this same piece of folded material 30 from the side, showing the folds 36*a* through 36*h* in the material. Because the distance between adjacent folds alternates from greater to lesser, the layers are progressively offset and the folded piece lays relatively flat as shown in FIG. 6. Because every other fold is equidistant apart, the folded piece gives the appearance that it is constructed of a series of pieces of equal width (but varying length) as shown in FIG. 5. In preferred embodiments pieces are folded at least six times so that the methodology provides a significant savings in quilt-making time by substantially reducing the number of stitches required.

After the material has been folded to give the desired appearance the piece is pinned or otherwise secured so that the folds remain in place when the folded pieces are joined together into blocks. Also, in a manner depending on the pattern desired, the folded top-layer pieces are interleaved along their edges so that the raw edges of each folded piece are hidden within the folds of adjacent pieces. In the preferred embodiment the folded and interleaved piece is further held together using a strip of interfacing fused to the back side of the folded material. The strip of interfacing is preferably ironed to the back of the folded piece and remains there after the quilt is complete.

After a number of pieces have been folded and secured in their folded positions the folded pieces are ready to be sewn or pieced together to form one block of a quilt top. According to one embodiment of the present invention, however, this step is accomplished at the same time as the addition of the batting and backing layers of the quilt. Therefore, before piecing the folded pieces of the quilt blocks together it is necessary to provide batting and backing layers cut to the size and shape of the finished blocks. To make the Log Cabin Square design described above and shown in FIG. 2, for example, the pieces of batting and backing material are preferably square in shape and are slightly longer on each side than the sides of a finished block.

After the batting, backing and folded top pieces are ready, they are assembled to form a textile "sandwich" with the batting layer positioned between the top and backing layers as shown in FIG. 1. Once the top layer pieces have been properly positioned and the layers have been arranged, the material is stitched to secure the various pieces of the top layer in their appropriate positions, and to secure the three layers together. In particular, it is preferred to use slip stitches along the interlocking edges from the top down, so that each stitch comes up and catches the folded edge and then goes down through all three layers. Thus, according to the present invention there is a significant savings of time as the blocks are both quilted and pieced at the same time.

After a number of quilt blocks have been prepared, the blocks are joined together to form a quilt. In particular, it is preferred to join the blocks together by sewing just the quilt tops with a running stitch to join the blocks into rows. Completed rows are then sewn together to form a finished quilt. The bottom layer or backing of the joined blocks is finished by turning excess fabric under and closing with a slip stitch. As is known in the quilt-making art, the quilt may be further improved by adding a binding or otherwise finishing the outer edges.

The foldable material used in the preferred embodiment can be any material suitable for the top layer of a quilt. Typically natural fabrics such as cotton, wool or silk are preferred, but a wide variety of man-made textiles may be used Because the materials useful for making a quilt according to the present invention are substantially comparable to the materials used in traditional quilt-making, the selection of the appropriate materials can be accomplished easily by one skilled in the art without undue experimentation.

It is to be appreciated that the present method of making a quilt utilizes many of the same materials and employs many of the same steps as are used with traditional methods. For example, it is preferred to meticulously plan the pattern, colors and textures to be used in the quilt so that the finished product is as aesthetically pleasing as possible. Also, the accuracy of cutting and sewing operations may be improved by first tracing lines or other indicators on the fabric with chalk or a pencil. Seam allowances should be carefully planned, marked and provided in the cut pieces. Pins, etc., may be used as needed to secure pieces of material in place, and are removed as the pieces are sewn together.

For the purposes of promoting a further understanding of the invention and its preferred features and advantages, reference will now be made to the following specific example. It will be understood that this example is given by way of illustration and is not restrictive of the invention.

EXAMPLE: LOG CABIN SQUARE

The Log Cabin Square design is one of the oldest and best-known of all quilt patterns. When finished, the quilt blocks are typically square in shape and appear to be formed of a series of rectangular blocks arranged around a square center piece as shown in FIG. 2.

To make the Log Cabin Square pattern according to the present invention, five pieces of material of two different shapes are used to make each block of the quilt. One of the pieces is square and forms the center piece 22 of the block, while the other four pieces are each shaped as shown in FIG. 3.

Before folding, the non-center (or "outer") pieces are joined at their narrow ends 32 to the sides 41 of a square center piece 22, one folded piece to each side. This is preferably done by placing the right sides together and sewing with a running stitch. After sewing, seams are pressed away from center and the block is turned right side up. Straight pins may be used to secure areas that extend beyond the center. The outer pieces of material are folded along the lines shown in FIG. 3 in the manner shown in FIG. 6. When folded, each piece will appear as a composite of smaller pieces as shown in FIG. 5. In the preferred embodiment, all four outer pieces are folded toward the center by working around the square one row at a time, interleaving with adjacent pieces so that the raw edges of each piece are hidden within the folds of the adjacent pieces. After all five rows are completed and the four outer pieces of material have been folded and interleaved, the square block appears to have been pieced from 21 pieces of fabric.

Figure 7:
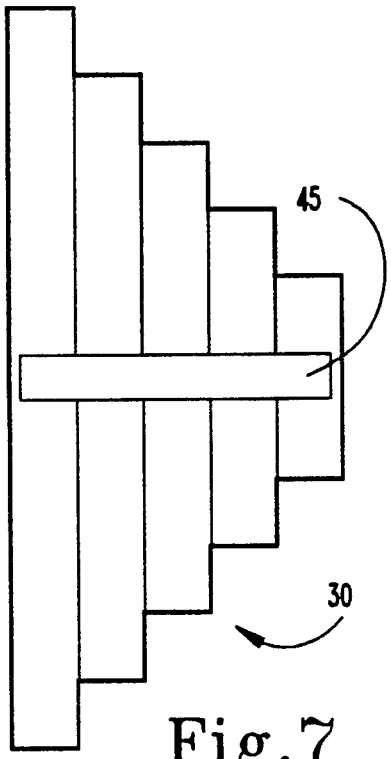
FIG. 7 is a bottom plan view of a folded piece of material cut and folded according to a typical embodiment of the present invention, showing the placement of a strip of interfacing on a piece cut for the Log Cabin Square pattern.

The folded block is secured in its folded position by turning the block upside down and ironing a strip of interfacing 45 to the back of each folded piece 30 as shown in FIG. 7. It is preferred to leave any straight pins in place.

After the individual blocks have been made they are ready to be joined to the batting and backing materials. To do this, it is preferred to cut the batting and backing material into squares somewhat larger than the finished blocks. For example, if the finished blocks are to be 12 inches on each side, the batting and backing materials should be cut into 14 inch (per side) squares. If desired, the backing and batting materials can be cut to the size of several joined squares, e.g., four squares, so that a fewer number of cuts are needed for this step.

After the top, batting and backing pieces are ready, the layers are assembled to form the textile sandwich as shown in FIG. 1. It is preferred to use pins to hold the folded top, batting and backing layers together in their respective positions. Then, from the top side, slip stitches are made along the interlocked edges so that each stitch comes up and catches the folded edge and then goes down through all three layers. As was noted above, this method accomplishes both piecing and quilting at the same time while maintaining the look of an individually pieced quilt. Note that it is not necessary to quilt along the other folds since the interfacing will hold them in place. Note too that the quilting/piecing stitches will be invisible from the front of the quilt.

When all the blocks have been quilted, the blocks are joined together to form a quilt. As was noted above, it is preferred to join the blocks together by sewing just the quilt tops with a running stitch to join the blocks into rows. Backing of blocks is closed with a slip stitch. Completed rows are then sewn together to form a finished quilt and a binding or other decorative trim may be added to finish the outer edges.

It should be understood that many changes or modifications can be made to adapt this methodology to a particular quilt pattern or design without changing the basic features of the present invention. In particular, the shapes of the pieces to be folded and the style of the folds to be used will vary according to the design desired. Also, many of the steps described above can be accomplished in alternative sequences; e.g., the folded and interleaved quilt block tops can be joined together before backing and insulation layers are added, or each folded and interleaved quilt block top can be sewn to the backing and insulation layers before the quilted blocks are joined. Therefore, while the invention has been described in detail in the foregoing example and description, the same are to be considered illustrative and not restrictive in character. For example, alternative patterns including Log Cabin Hexagon, Log Cabin Pyramid, Pineapple, Tree Everlasting and Flying Geese, may be made according to the present invention as shown in FIGS. 8–19.

Figure 8:
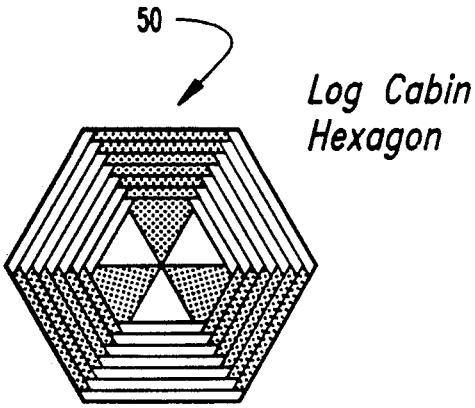
FIG. 8 is a top plan view of one block of the top layer of a quilt according to a typical embodiment of the present invention. The pattern shown is Log Cabin Hexagon.
Figure 9A:
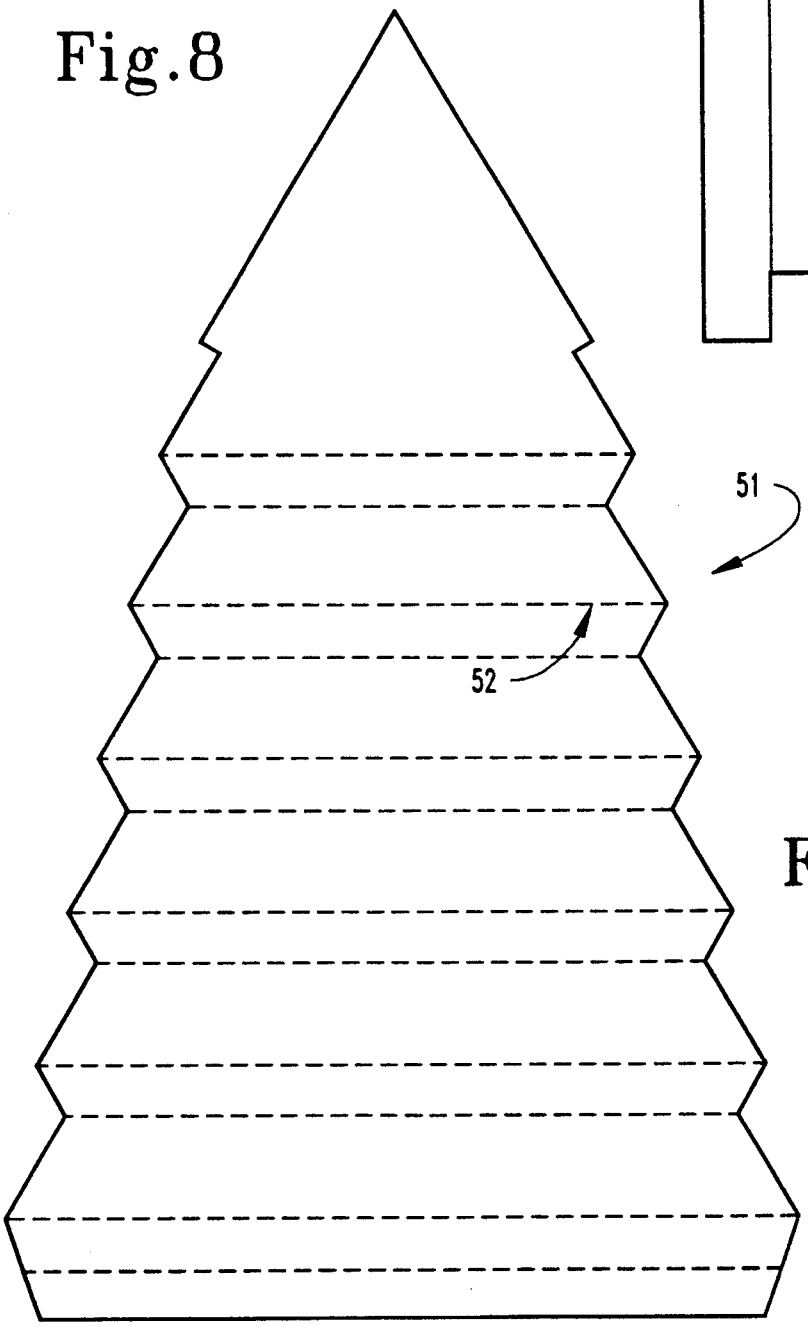
Figure 9B:
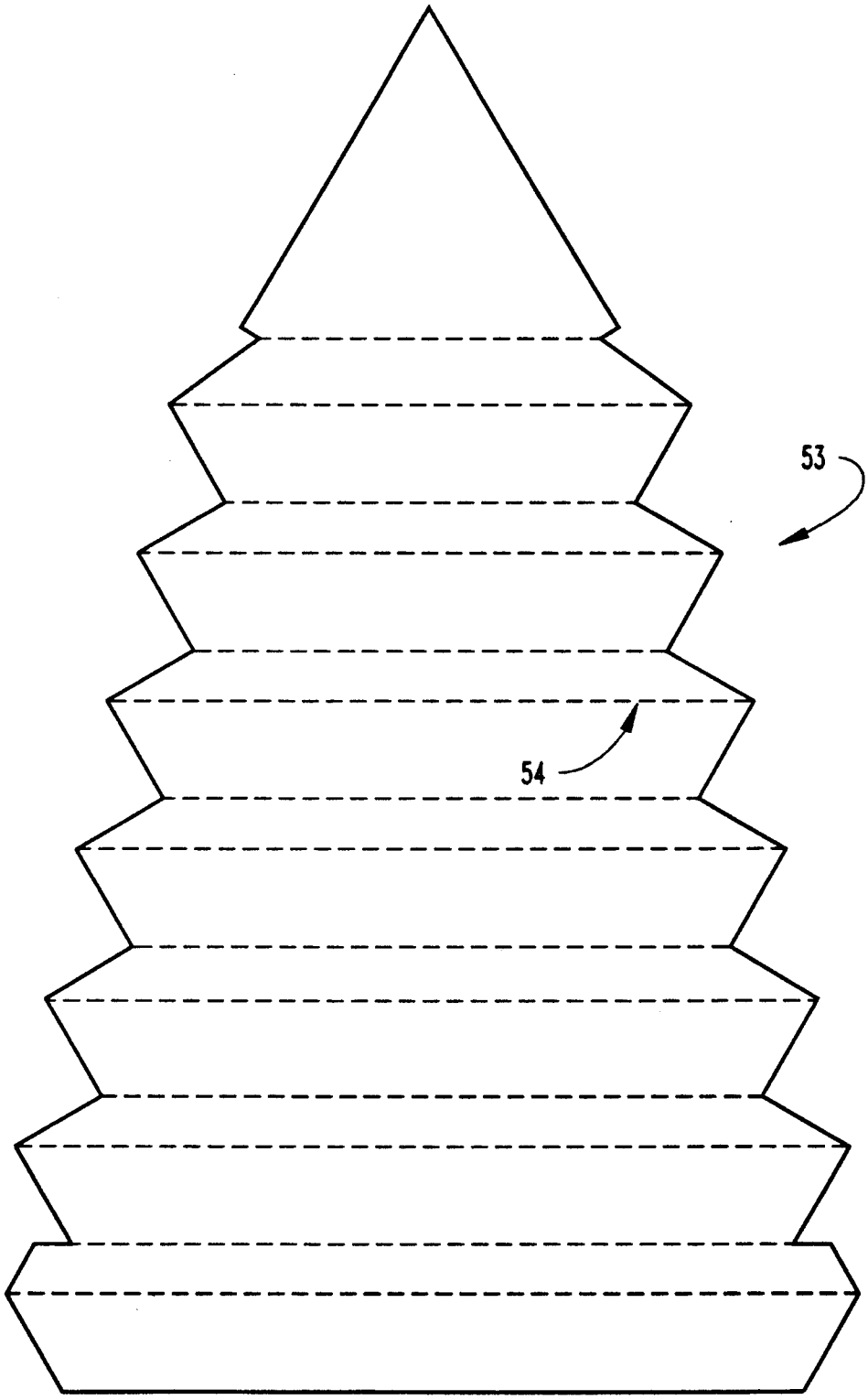

Accordingly, FIG. 8 shows one block 50 of the Log Cabin Hexagon pattern. FIG. 9*a* shows one piece 51 of foldable material cut to make the Log Cabin Hexagon pattern, and further shows the lines 52 along which the material is to be folded. FIG. 9*b* shows another piece 53 of foldable material cut to make the Log Cabin Hexagon pattern, and further shows the lines 54 along which that piece of material is to be folded. FIG. 10 shows one block 56 of the Log Cabin Pyramid pattern. FIG. 11*a* shows one piece 57 of foldable material cut to make the Log Cabin Pyramid pattern, and further shows the lines 58 along which the material is to be folded. FIG. 11*b* shows the piece of non-folded material which forms the center of a Log Cabin Pyramid quilt block. FIG. 12 shows one block 60 of the Log Cabin Diamond pattern. FIGS. 13*a* and 13*b* show pieces 61 and 62 of foldable material cut to make the Log Cabin Diamond pattern, and further show the lines 63 and 64 along which those pieces of material are to be folded. FIG. 13*c* shows the center piece 66 of material which is not folded and forms the center of the Log Cabin Diamond pattern. FIG. 14 shows one block 68 of the Pineapple pattern. FIGS. 15*a* and 15*b* show pieces 69 and 70 of foldable material cut to make the Pineapple pattern, and further show the lines 71 and 72 along which those pieces of material are to be folded. FIG. 15*c* shows the center piece 75 of material which is not folded and forms the center of the Pineapple pattern. FIG. 16 shows one block 80 of the Flying Geese pattern. FIGS. 17*a* and 17*b* show pieces 82 and 83 of foldable material shaped to make the Flying Geese pattern, and further shows the lines 84 and 85 along which those pieces of material are to be folded. FIG. 18 shows one block 86 of the Tree Everlasting pattern. FIGS. 19*a* and 19*b* show pieces 87 and 88 of foldable material shaped to make the Tree Everlasting pattern, and further show the lines 89 and 90 along which those pieces of material are to be folded.

It is to be understood that only the most preferred embodiments have been shown and described, and that all changes and modifications that come within the spirit of the invention are desired to be protected.

I claim:

1. A method of constructing a patchwork quilt, which method comprises the steps of:

(a) providing a plurality of pieces of foldable material shaped so that each piece can be folded to form a single piece of material for use in a quilt block, wherein the single piece of material gives the appearance of being several smaller pieces of material;

(b) folding said foldable material pieces to form folded material pieces giving the appearance of being several smaller pieces which have been sewn together;

(c) interleaving at least three layers and joining said foldable material pieces to form the top layer of one block of a quilt, said top layer having a top surface and a bottom surface, and having the appearance that the quilt block is comprised of a larger number of pieces than are actually used to make the quilt block;

(d) providing a layer of insulating material adjacent to the bottom surface of said top layer of folded material pieces;

(e) providing a layer of backing material adjacent to the insulation material on the side opposite the folded material pieces;

(f) sewing the backing material to the insulating material and the folded material pieces to form a quilt block having insulating material contained in a space between the backing material and the folded material pieces;

(g) repeating steps (a) through (f) until enough quilt blocks have been made to form a patchwork quilt; and (h) sewing the quilted blocks together to form a patchwork quilt.

2. The quilt-making method according to claim 1, wherein the sewing of the layer of backing material to the layers of insulating material and top layer material accomplishes both a quilting and a piecing together of a quilt block.

3. The quilt-making method according to claim 1, wherein the top layer of the quilt also includes pieces of material which are substantially unfolded.

4. The quilt-making method according to claim 1, wherein said folding and interleaving step includes interleaving adjacent edges of said foldable material pieces so that the raw edges of each folded piece are hidden within the folds of the adjacent pieces.

5. The quilt-making method according to claim 1, wherein said folding step includes making a series of folds parallel to each other.

6. The quilt-making method according to claim 1, and further including the step of using fusible interfacing to secure each piece of foldable material in its folded position.

7. The quilt-making method according to claim 1, wherein said folding step includes folding said foldable material pieces to form pieces having the appearance of being comprised of at least four smaller pieces which have been sewn together.

8. A patchwork quilt comprising a multiplicity of blocks, each block having:

(a) a top layer comprised of a plurality of adjacent folded material pieces, said folded pieces joined and interleaved with one another over at least three layers, wherein the appearance of the top layer is of a larger number of folded pieces than is actually used to make the top layer;

(b) a layer of insulating material having a side adjacent said top layer; and (c) a bottom layer of material adjacent an opposite side of said insulating layer to contain said insulating material between said top and bottom layers of material.

9. The patchwork quilt according to claim 8 wherein the top layer of the quilt further includes a number of pieces which are substantially unfolded.

10. The patchwork quilt according to claim 8 wherein the top layer of the quilt further includes fusible interfacing securing each piece of foldable material in its folded position.

11. A method of constructing a patchwork quilt, which method comprises the steps of:

(a) providing a plurality of pieces of foldable material shaped so that the pieces can be folded and sewn together with unfolded pieces to make a quilt that gives the appearance of being several smaller pieces of material;

(b) providing a plurality of unfolded pieces of material shaped to cooperate with said foldable pieces to make the top layer of a quilt that gives the appearance of being several smaller pieces of material;

(c) sewing foldable pieces to the unfolded pieces to form a composite piece of material;

(d) folding and interleaving at least three layers of said foldable material pieces so that the composite piece forms the top layer of a quilt block, said top layer having a top surface and a bottom surface and giving the appearance that the top layer is comprised of several smaller pieces of material;

(e) providing a layer of insulating material adjacent to the bottom surface of said top layer;

(f) providing a layer of backing material adjacent to the insulation material to form a three-layered composite wherein the insulation material is contained between the backing material and the top layer;

(g) sewing the backing material to the top layer and the insulating material to form a quilt block having insulating material contained in the space between the backing material and the top layer;

(h) repeating steps (a) through (g) until enough quilt blocks have been made to form a patchwork quilt; and (i) sewing the quilt blocks together to form a patchwork quilt.

12. The quilt-making method according to claim 11, wherein said folding and interleaving step includes interleaving adjacent edges of said foldable material pieces.

13. The quilt-making method according to claim 11, wherein said folding step includes making a series of parallel folds.

14. A method of constructing a patchwork quilt, which method comprises the steps of:

(a) providing a plurality of pieces of foldable material shaped so that the pieces can be folded and sewn together to make a quilt that gives the appearance of being several smaller pieces of material;

(b) sewing the foldable pieces together to form a composite piece of material;

(c) folding and interleaving at least three layers of said foldable material pieces so that the composite piece forms the top layer of a quilt block, wherein said top layer has a top surface and a bottom surface and presents the appearance that the quilt block is comprised of several smaller pieces of material;

(d) providing a layer of insulating material adjacent to the bottom surface of said top layer;

(e) providing a layer of backing material adjacent to the insulation material to form a three-layered composite wherein the insulation material is contained between the backing material and the top layer;

(f) sewing the backing material to the top layer and the insulating material to form a quilt block having insulating material contained in the space between the backing material and the top layer;

(g) repeating steps (a) through (f) until enough quilt blocks have been made to form a patchwork quilt; and (h) sewing the quilt blocks together to form a patchwork quilt.

15. The quilt-making method according to claim 14, wherein said folding and interleaving step includes interleaving adjacent edges of said foldable material pieces.

16. The quilt-making method according to claim 14, wherein said folding step includes making a series of parallel folds.

17. A method of constructing a patchwork quilt, which method comprises the steps of:

(a) providing a plurality of pieces of foldable material shaped so that the pieces can be folded and sewn together with unfolded pieces to make a quilt that gives the appearance of being several smaller pieces of material;

(b) providing a plurality of pieces of material shaped to cooperate with said foldable pieces to make the top layer of a quilt that gives the appearance of being several smaller pieces of material;

(c) sewing the foldable pieces to the pieces which are not to be folded to form a composite piece of material;

(d) folding and interleaving at least three layers of said foldable material pieces of the composite piece so that the composite piece forms the top layer of a quilt block, said top layer having a top surface and a bottom surface and giving the appearance that the top layer is comprised of several smaller pieces of material;

(e) repeating steps (a) through (d) until enough composite pieces have been folded to form the top layer of a patchwork quilt;

(f) sewing the folded composite pieces together to form the top layer of a patchwork quilt.

(g) providing a layer of insulating material adjacent to the bottom surface of said top layer;

(h) providing a layer of backing material adjacent to the insulation material to form a three-layered composite wherein the insulation material is contained between the backing material and the top layer; and (i) sewing the backing material to the top layer and the insulating material to form a quilt having insulating material contained in the space between the backing material and the top layer.

18. The quilt-making method according to claim 17, wherein said and interleaving step includes interleaving adjacent edges of said foldable material pieces.

19. The quilt-making method according to claim 17, wherein said folding step includes making a series of parallel folds.

20. A method of constructing a patchwork quilt, which method comprises the steps of:

(a) providing a plurality of pieces of foldable material shaped so that the pieces can be folded and sewn together to make a quilt that gives the appearance of being several smaller pieces of material;

(b) sewing the foldable pieces together to form a composite piece of material;

(c) folding and interleaving at least three layers of said foldable material pieces so that the composite piece forms the top layer of a quilt block, wherein said top layer has a top surface and a bottom surface and gives the appearance of being several smaller pieces of material;

(d) repeating steps (a) through (c) until enough composite pieces have been folded to form the top layer of a patchwork quilt;

(e) sewing the folded composite pieces together to form the top layer of a patchwork quilt.

(f) providing a layer of insulating material adjacent to the insulation material to form a three-layered composite wherein the insulation material is contained between the backing material and the top layer; and (h) sewing the backing material to the top layer and the insulating material to form a quilt having insulating material contained in the space between the backing material and the top layer.

21. The quilt-making method according to claim 20, wherein said folding and interleaving step includes interleaving adjacent edges of said foldable material pieces.

22. The quilt-making method according to claim 20, wherein said folding step includes making a series of parallel folds.

* * * * *

UNITED STATES PATENT AND TRADEMARK OFFICE

CERTIFICATE OF CORRECTION

PATENT NO. : 5,272,995

DATED : December 28, 1993

INVENTOR(S) : Rebecca A. Harger

It is certified that error appears in the above-identified patent and that said Letters Patent is hereby corrected as shown below:

In column 6, line 54, please begin a new paragraph after the word "center.".

In column 11, line 25, after the word "said" insert the word -- folding --.

In column 12, line 17, after the word "the" delete the remainder of subparagraph (f) through line 20, and insert in lieu thereof:

-- bottom surface of said top layer;

(g) providing a layer of backing material adjacent to the insulation material to form a three-layered composite wherein the insulation material is contained between the backing material and the top layer; and --.

Signed and Sealed this

Seventeenth Day of May, 1994

Bruce Lehman

*Attest:*

BRUCE LEHMAN

*Attesting Officer*

*Commissioner of Patents and Trademarks*